US012788164B2

(12) United States Patent
Stojanovic et al.

(10) Patent No.: US 12,788,164 B2
(45) Date of Patent: Nov. 10, 2026

(54) PILLOW COOLING SYSTEM

(71) Applicant: SNBR INC., Minneapolis, MN (US)

(72) Inventors: Heidi Stojanovic, Fort Smith, AR (US); Sydney Wells, Fort Smith, AR (US); Matthew D. Mcknight, Fort Smith, AR (US)

(73) Assignee: SNBR Inc.

( * ) Notice: Subject to any disclaimer, the term of this patent is extended or adjusted under 35 U.S.C. 154(b) by 519 days.

(21) Appl. No.: 18/171,481

(22) Filed: Feb. 20, 2023

(65) Prior Publication Data

US 2024/0099485 A1 Mar. 28, 2024

Related U.S. Application Data

(60) Provisional application No. 63/408,984, filed on Sep. 22, 2022.

(51) Int. Cl.
*A47G 9/10* (2006.01)

(52) U.S. Cl.
CPC ..... *A47G 9/1036* (2013.01)

(58) Field of Classification Search
CPC .... A47C 7/744; A47C 21/044; A47G 9/1036; A61G 5/1048; A61G 7/05784; A61G 7/05792
USPC ..... 5/636, 638
See application file for complete search history.

(56) References Cited

U.S. PATENT DOCUMENTS 96,989 A * 11/1869 Somes ..... A47C 21/044 126/210
813,731 A * 2/1906 Murmans ..... A47C 21/044 5/641
2,493,067 A * 1/1950 Goldsmith ..... A47C 21/048 219/217
2,826,244 A * 3/1958 Hurley ..... A47C 7/18 297/DIG. 2
2,913,833 A * 11/1959 Glintz ..... A45D 20/00 5/639
3,251,078 A * 5/1966 Calla ..... A47C 27/064 267/143
3,529,310 A * 9/1970 Olmo ..... A47C 21/044 297/180.13
4,006,604 A * 2/1977 Seff ..... F24F 1/04 5/284
8,181,290 B2 5/2012 Brykalski et al.
8,332,975 B2 12/2012 Brykalski et al.
9,125,497 B2 9/2015 Brykalski et al.
9,131,781 B2 9/2015 Zaiss et al.
(Continued)

FOREIGN PATENT DOCUMENTS

CN 1310592 A 8/2001
EP 3262989 A1 * 1/2018 ..... A47G 9/1036

*Primary Examiner* — Eric J Kurilla
(74) *Attorney, Agent, or Firm* — Norton Rose Fulbright US LLP

(57) ABSTRACT

A pillow cooling system uses a blower unit spaced from the pillow to cool the sleeping surface of the pillow. The blower unit uses a fan to either push or pull air through an air tube extending between the blower unit and the pillow. A distal end of the air tube is joined to an air passage extending from a central core of the pillow through a foam shell of the pillow which surrounds the core of the pillow. The core of the pillow allows air to pass therethrough more easily than the foam shell of the pillow, facilitating the breathability of the pillow.

20 Claims, 19 Drawing Sheets

(56) References Cited

U.S. PATENT DOCUMENTS

| | | | | |
|---|---|---|---|---|
| 9,314,118 | B2 | 4/2016 | Blazar et al. | |
| 9,974,394 | B2 | 5/2018 | Brykalski et al. | |
| 10,772,438 | B2 | 9/2020 | Griffith et al. | |
| 11,962,164 | B2 | 4/2024 | Holmvik et al. | |
| 12,127,678 | B2 | 10/2024 | Sayadi et al. | |
| 2004/0182087 | A1* | 9/2004 | Huang | A47C 21/044 62/3.4 |
| 2010/0101418 | A1* | 4/2010 | Augustine | A61G 13/108 55/383 |
| 2015/0272354 | A1* | 10/2015 | Asklof | A47C 7/18 5/636 |
| 2015/0282631 | A1* | 10/2015 | Creamer | A47C 21/044 5/423 |
| 2016/0066716 | A1* | 3/2016 | Rao | A61B 5/6814 600/26 |
| 2017/0280883 | A1 | 10/2017 | Diller | |
| 2018/0242753 | A1* | 8/2018 | Ghanei | A47C 21/044 |
| 2020/0029703 | A1* | 1/2020 | Alletto, Jr. | A47C 23/00 |
| 2021/0177166 | A1* | 6/2021 | Lemieux | F24H 9/12 |
| 2021/0204713 | A1 | 7/2021 | Karschnik et al. | |
| 2022/0261020 | A1 | 8/2022 | Garcia Molina et al. | |
| 2022/0273115 | A1 | 9/2022 | Karschnik et al. | |
| 2022/0408945 | A1* | 12/2022 | Manuszak | A47C 27/20 |
| 2024/0023721 | A1* | 1/2024 | Tar | A47C 21/044 |
| 2024/0277166 | A1 | 8/2024 | Thompson et al. | |
| 2024/0358166 | A1 | 10/2024 | Palashewski et al. | |

* cited by examiner

PILLOW COOLING SYSTEM

CROSS-REFERENCE TO RELATED APPLICATIONS

This application claimed the benefit of priority to U.S. Provisional Patent Application Ser. No. 63/408,984 filed Sep. 22, 2022, the disclosure of which is incorporated by reference herein.

FIELD OF THE INVENTION

This invention relates generally to bedding products and, more particularly, to a pillow cooling system.

BACKGROUND OF THE INVENTION

Conventional molded foam pillows are usually made of one piece of foam with uniform properties throughout the foam piece. A cover surrounds the piece of foam. The shapes of the foam pieces may vary depending upon consumer preference.

One common complaint about conventional molded foam pillows is that the sleeping surface becomes warm or even hot over time. This may cause the head and/or neck of the person sleeping on the pillow to sweat. Such sweating may awaken the person sleeping on the pillow. In some extreme conditions, the sweat or perspiration may cause the pillow's user to become ill with for example, a cold.

Another drawback to known conventional molded foam pillows is that over time the foam of the pillow may lose its resiliency or bounce back properties.

In view of the above, there is a need for a molded foam pillow having a core which is more breathable than a breathable outer shell. There is further a need for a molded foam pillow having an attachment mechanism to which a hose may be attached for inserting air into the pillow.

It is therefore an objective of this invention to provide breathable pillow having an active cooling system which may be used to cool a foam pillow.

It is further an objective of this invention to provide a breathable pillow having an insert or core which is more breathable than its external portion to improve airflow through the pillow.

SUMMARY OF THE INVENTION

According to one aspect of the invention, a pillow cooling system comprises a pillow and a blower unit. The pillow comprises a core and a foam shell surrounding the core. An air passage extends through the foam shell from the core to an exterior surface of the pillow. The air passage is preferably linear and made of a material impermeable to airflow such as a fabric impermeable to airflow.

The pillow cooling system further comprises a blower unit comprising an air tube in fluid communication with the air passage of the pillow to allow air to flow from the blower unit to the pillow. The blower unit comprises a blower fan in one embodiment. The blower unit may be partially or wholly insulated for noise reduction. Upon activation, the fan of the blower unit pushes ambient air through the air tube into the air passage of the pillow into the core of the pillow. Air is pushed out of the core of the pillow and into the foam shell of the pillow. The air exits the pillow after passing through the foam shell.

The blower unit may be wired with an on/off switch with or without a speed control such as a knob. Alternatively, the blower unit may be remotely controlled via blue tooth.

The core of the pillow of the pillow cooling system comprises at least one of the following: pocketed coil springs, melt blown fiber mesh, spacer fabric and reticulated foam. The outer foam shell of the pillow is preferably made of polyurethane foam but may be made of other known foams. In some embodiments the foam of the core may be the same shape as the outer shell of the pillow. Alternatively, the core foam may be shaped differently than the outer shell of the pillow. For example, the core may be a single piece of foam having a rectangular shape in cross section.

According to another aspect of the invention, the fan of the blower unit pulls ambient air through the foam shell of the pillow into the core of the pillow and then through the air passage of the pillow into the air tube of the blower unit. Air may exit the blower unit in any known manner. In this embodiment, the fan may be wired with an on/off switch with or without a speed control such as a knob. Alternatively, the blower unit may be remotely controlled via blue tooth.

According to another aspect of the invention, a method of cooling the sleeping surface of a pillow is provided. The method comprises providing a pillow having a core as described above and foam shell surrounding the core as described above. The method further comprises activating a fan of a blower unit to push air through an air tube of the blower unit and through an air passage of the pillow into a core of the pillow. The air passage extends from the core of the pillow to an exterior surface of the pillow. The air passage and air tube of the blower unit may be joined together in any known manner. Upon activation, the fan of the blower unit pushes ambient air through the air tube and air passage into the core of the pillow. The breathability of the core of the pillow allows the air to pass through the core into the foam shell of the pillow. The air passes through the foam shell of the pillow before exiting the pillow through the exterior surface of the pillow.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
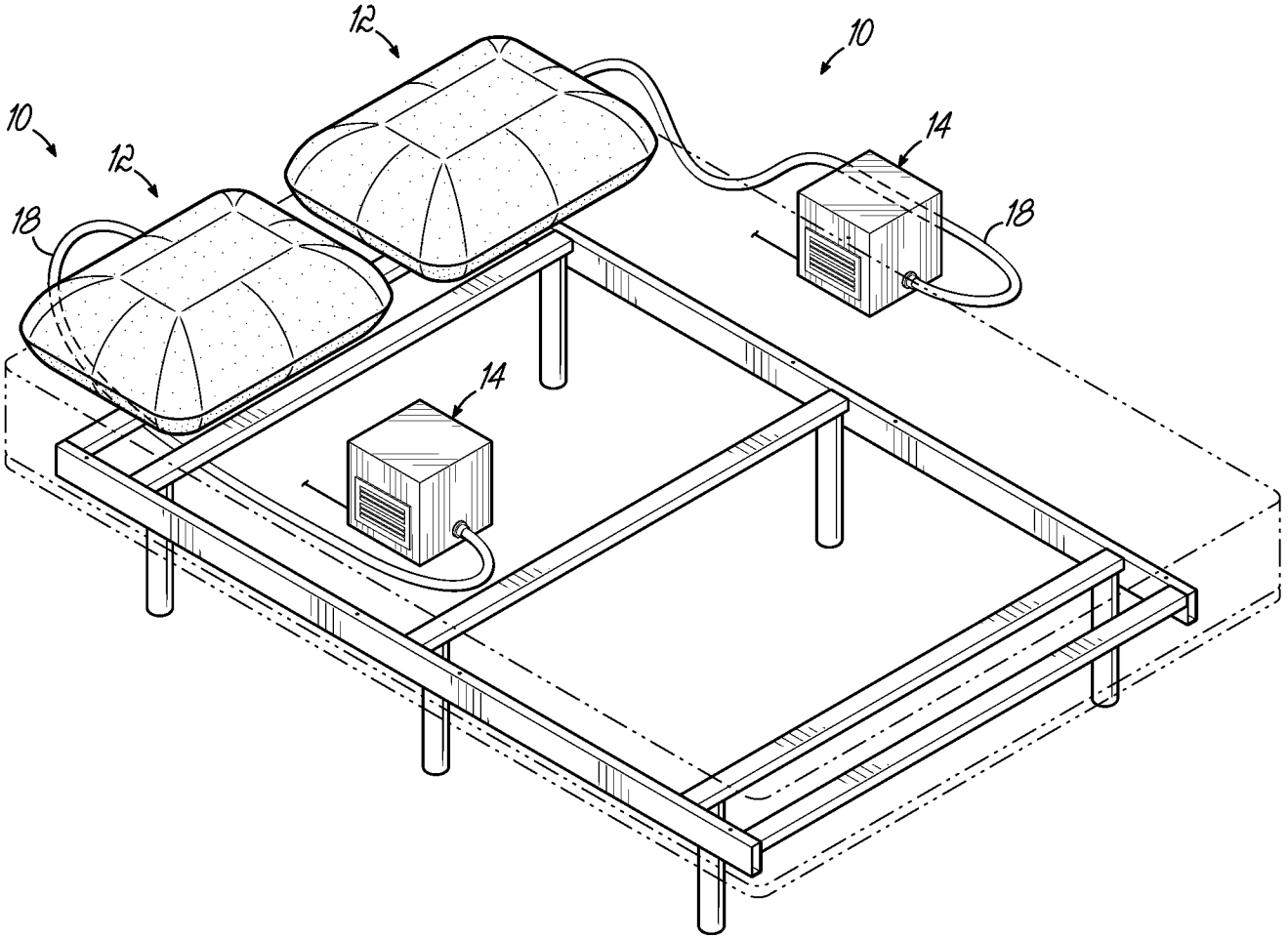
FIG. 1 is a perspective view of two pillow cooling systems in accordance with the present invention.

Referring to FIG. 1, a pillow cooling system 10 comprises a pillow 12 and a blower unit 14. FIG. 1 illustrates two such pillow cooling systems 10, each one having a pillow 12. The size and/or shape of the pillow 12 is not intended to be limited by the drawings. The same goes for the size and/or shape of the blower unit 14.

Figure 1A:
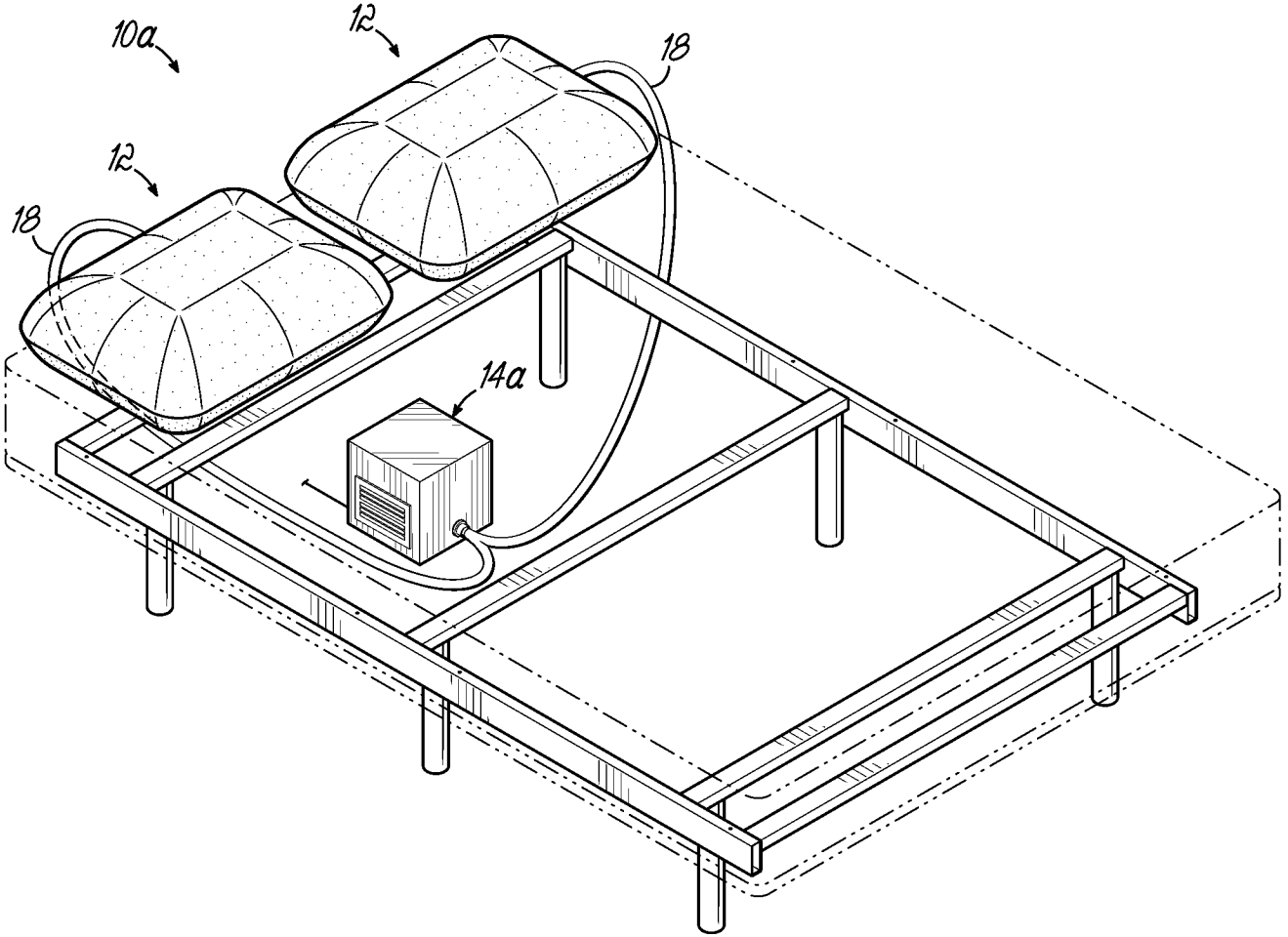
FIG. 1A is a perspective view of an alternative pillow cooling system in which one blower unit supplies air to two pillows or pulls air through two pillows.

FIG. 1A illustrates an alternative pillow cooling system 10*a* in which one blower unit 14*a* supplies air to two air tubes 18. Each air tube 18 is fluidly coupled to a pillow 12. Alternatively, such a system may be used to suck air through two pillows 12 and out blower unit 14*a*.

Figure 1B:
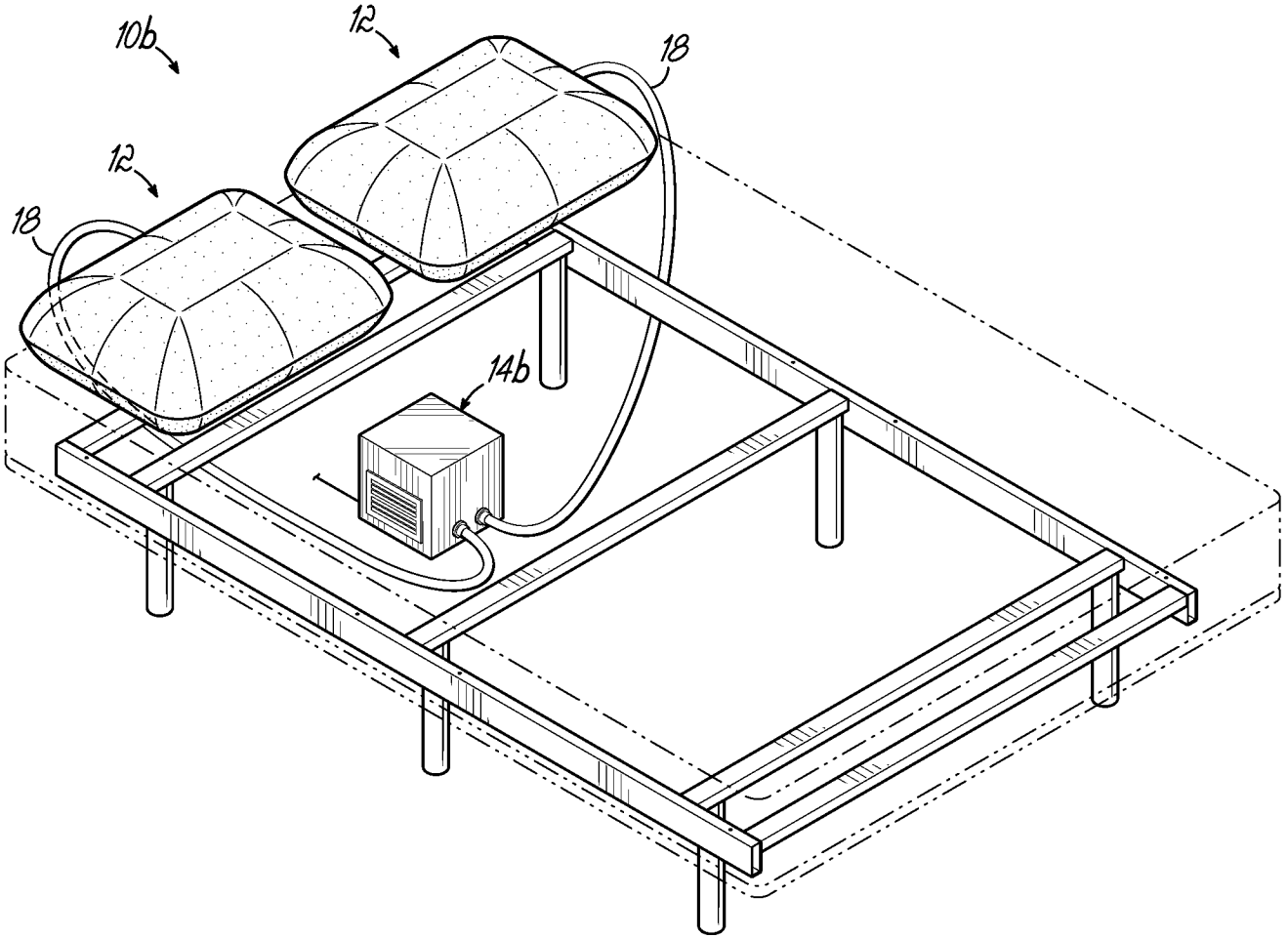
FIG. 1B is a perspective view of an alternative pillow cooling system with a different blower unit than the blower units of FIGS. 1 and 1A.

FIG. 1B illustrates an alternative pillow cooling system 10*b* in which one blower unit 14*b* supplies air to two air tubes 18. Each air tube 18 is fluidly coupled to a pillow 12. The blower unit 14*b* has two blower fans 70 and two outlets 72 as described below and shown in either FIG. 8C or 8D. Alternatively, such a system may be used to suck air through two pillows 12 and out blower unit 14*b*.

Figure 2:
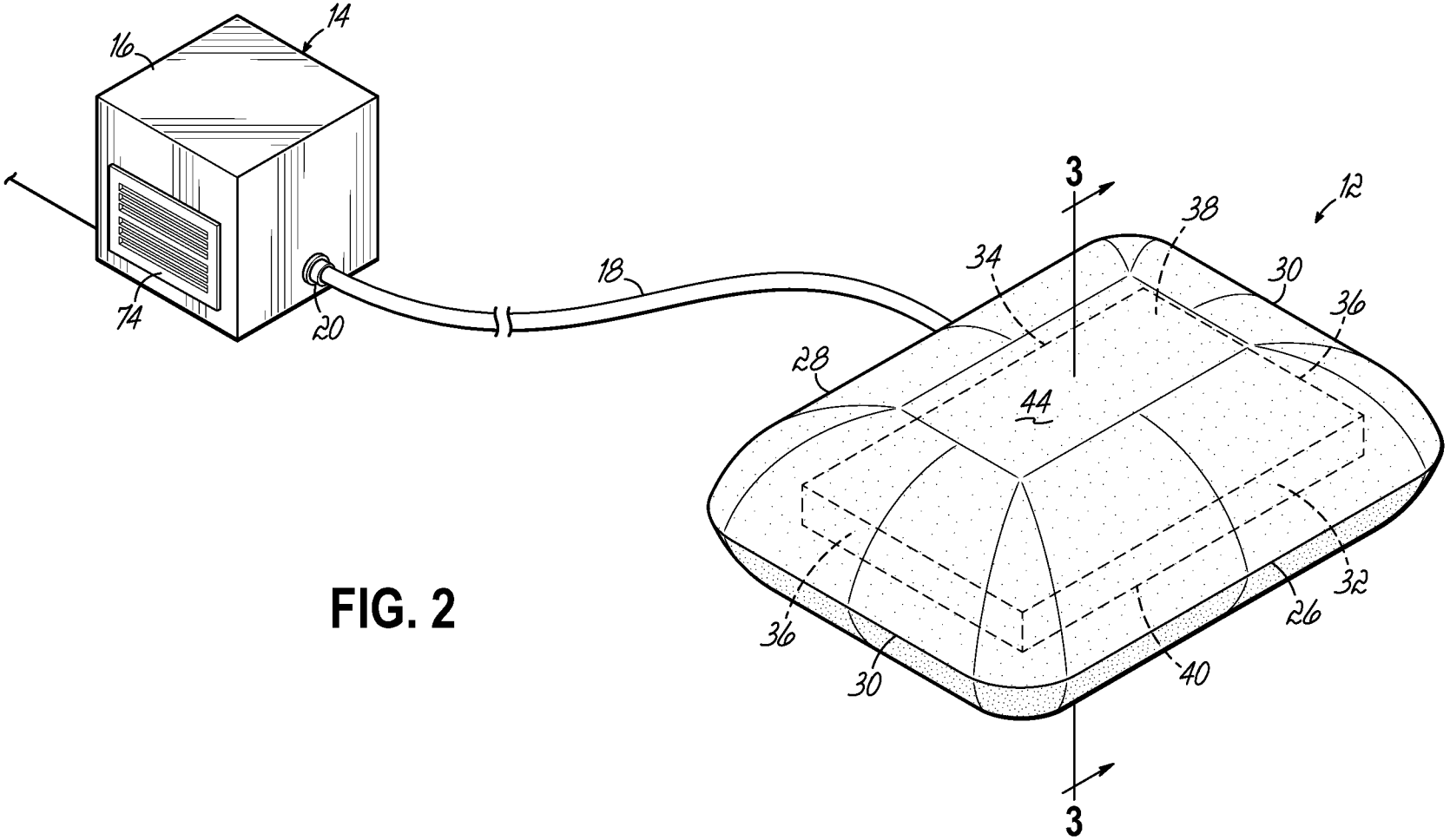
FIG. 2 is an enlarged perspective view of a portion of one of the pillow cooling systems of FIG. 1.
Figure 8A:
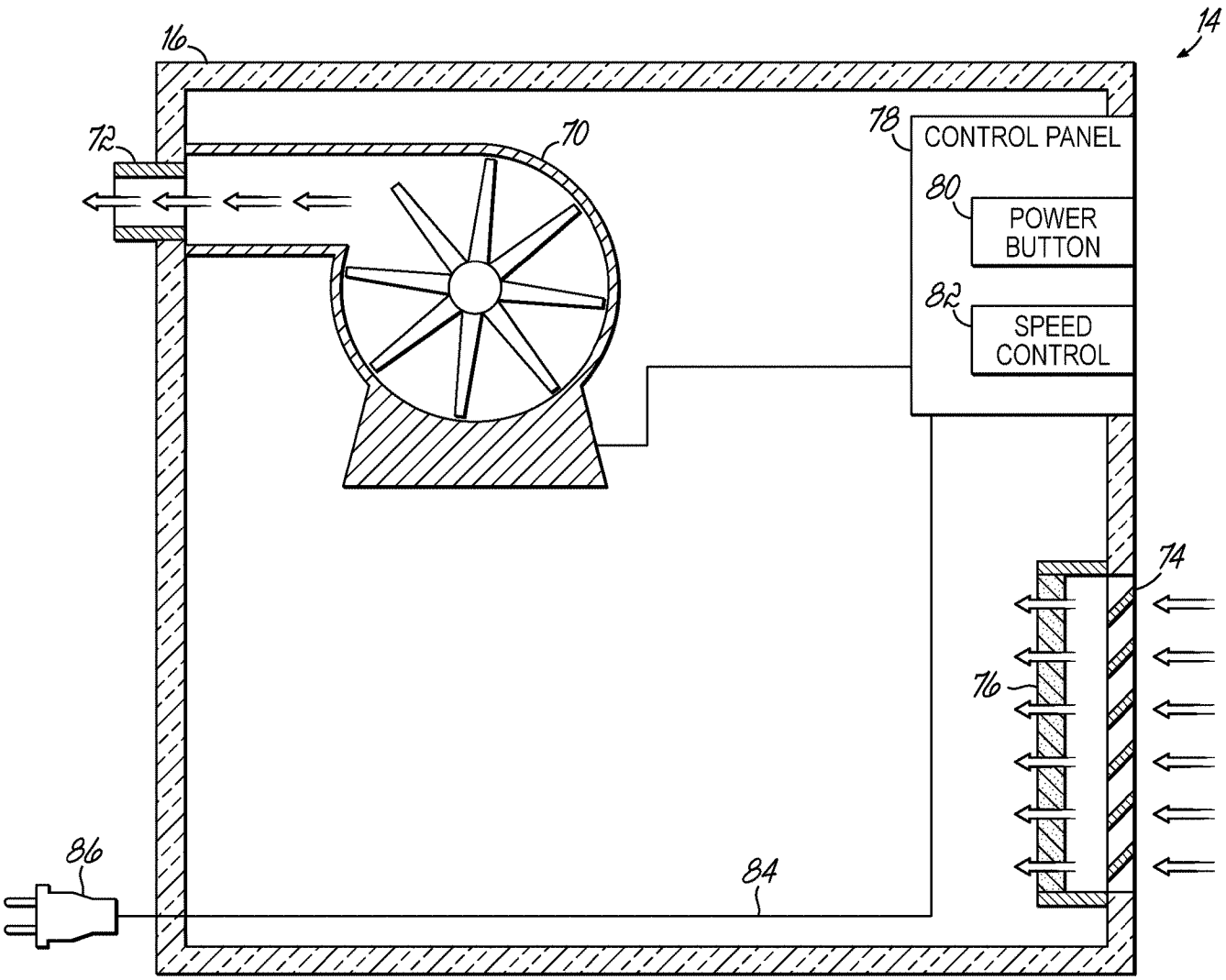
FIG. 8A is a schematic cross-sectional view of one embodiment of blower unit.
Figure 8B:
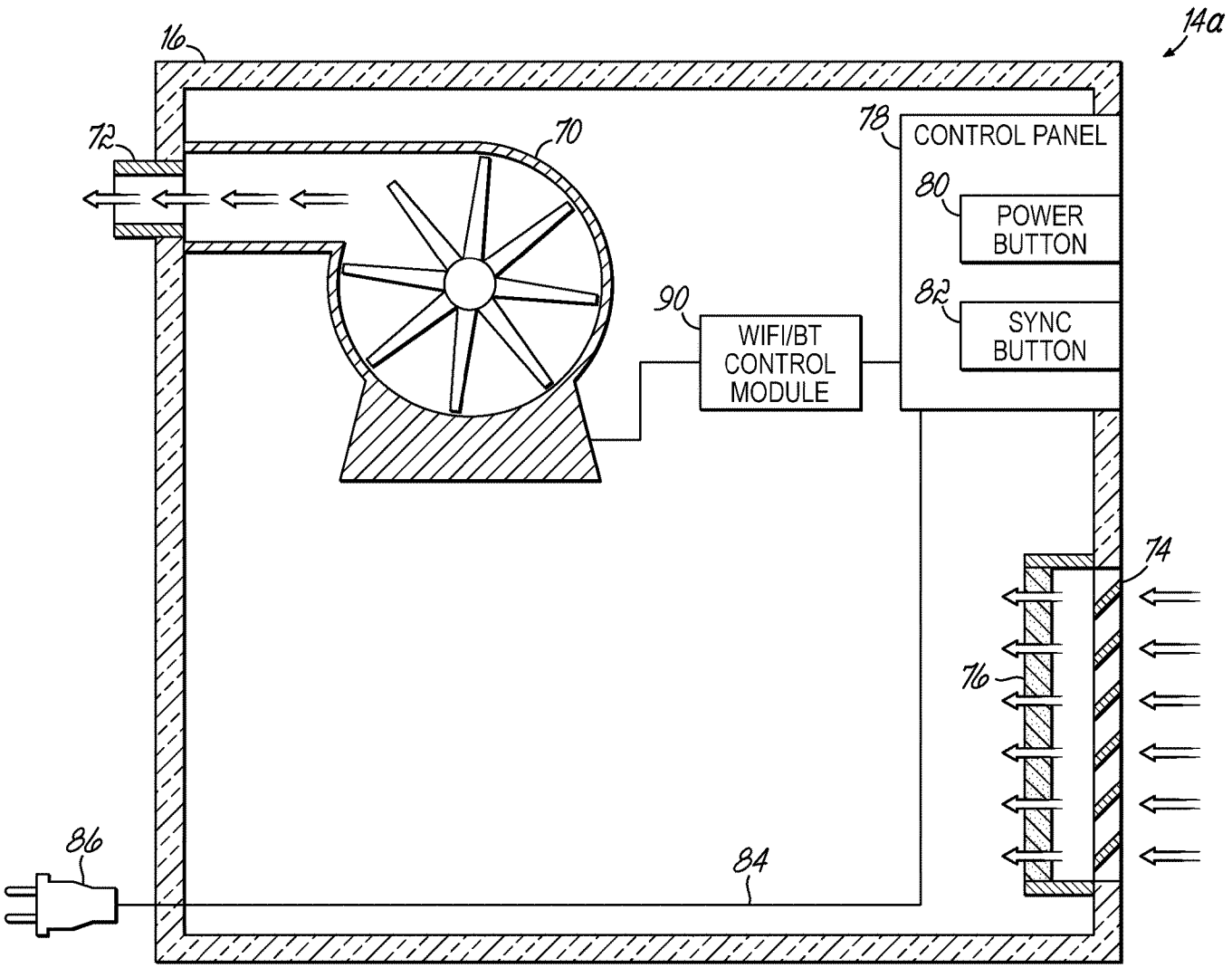
FIG. 8B is a schematic cross-sectional view of another embodiment of blower unit.
Figure 8C:
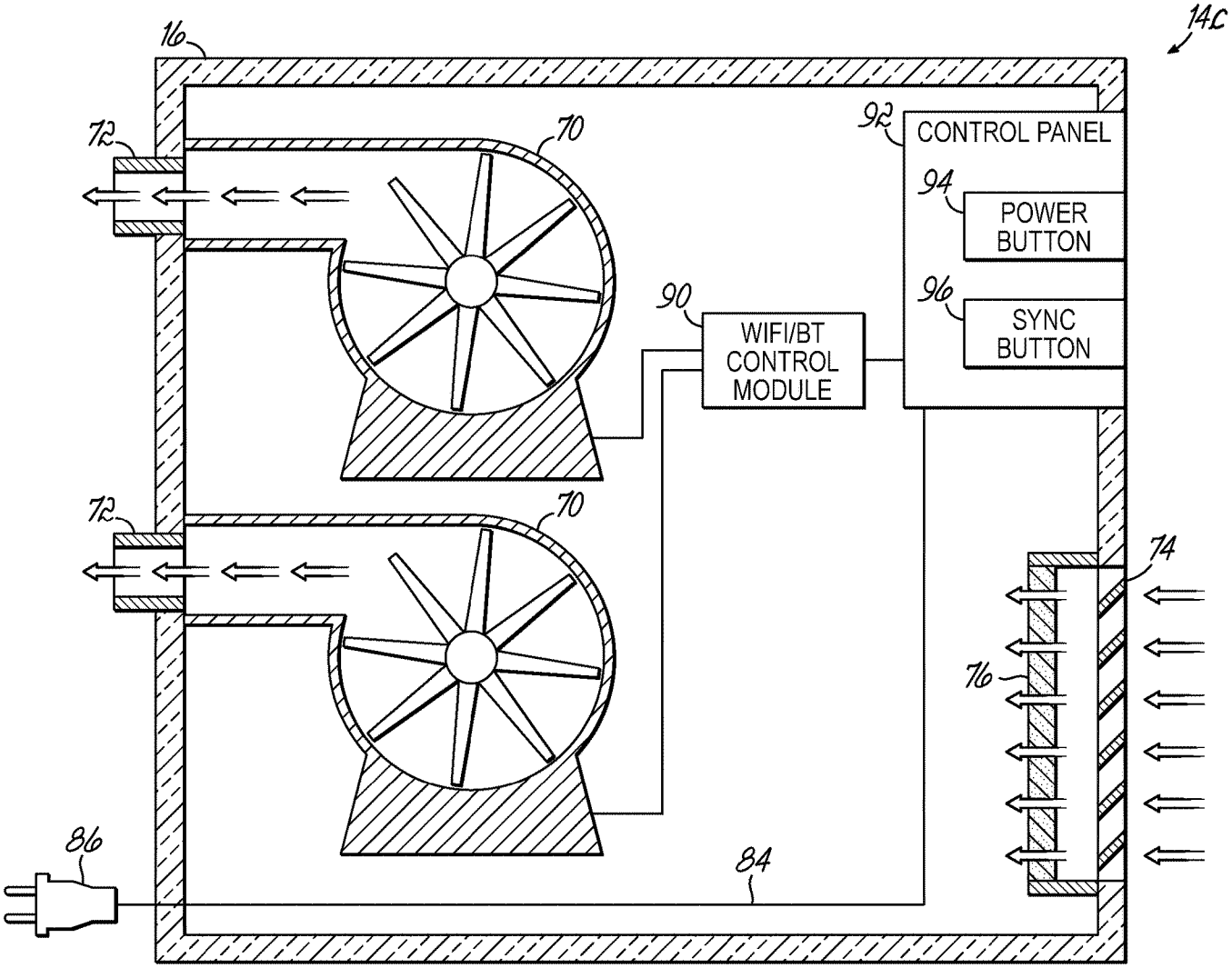
FIG. 8C is a schematic cross-sectional view of another embodiment of blower unit.

As best shown in FIG. 2, the blower unit 14 comprises a generally box-shaped housing 16, which is typically insulated as shown in FIGS. 8A-8C, and an air tube 18 extending out of the housing 16. FIG. 2 illustrates the air tube 18 extending outwardly from the housing 16 via a coupling 20 and entering a pillow 12 through the rear of the pillow 12. As shown in the other pillow cooling system shown in FIG. 1, the air tube 18 may enter a side of the pillow 12 or anywhere along the exterior surface of the pillow 12 including at a corner of the pillow.

Figure 3:
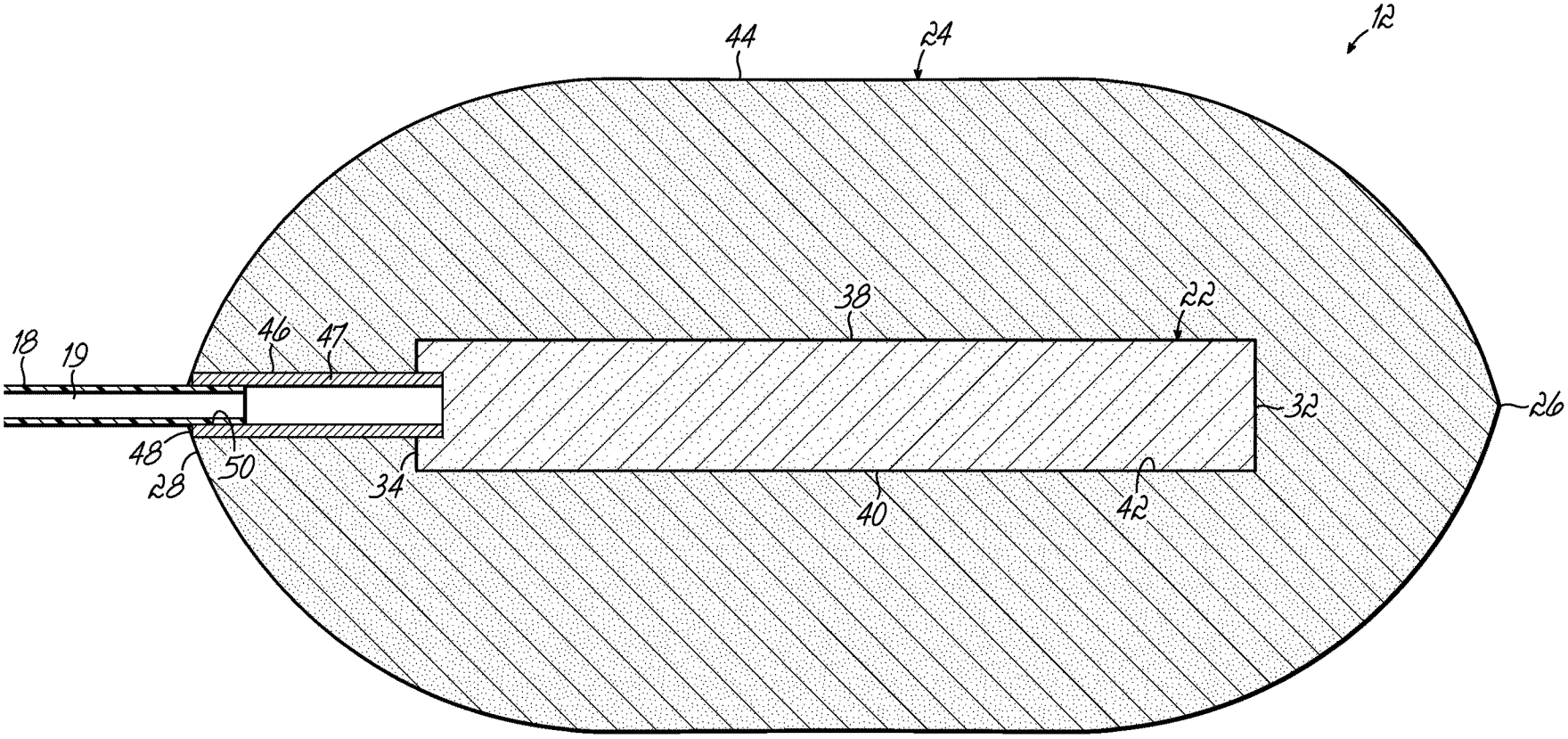
FIG. 3 is a cross-sectional view of the pillow of FIG. 2 taken along the line 3-3.

FIG. 3 illustrates one embodiment of pillow 12 comprising a core 22 and a foam shell 24 surrounding the core 22. FIG. 3 illustrates the core 22 being a single piece of foam in the shape of a parallelepiped having a rectangular shaped cross-section. For purposes of this document, as best seen in FIG. 2, the pillow 12 has a front 26, a rear 28 and sides 30. Therefore, the core 22 has a planar front surface 32, a planar rear surface 34, two side surfaces 36, a top surface 38 and a bottom surface 40. The foam shell 24 has an internal cavity 42 inside which the core 22 is located and an external surface 44. The core 22 of pillow 12*a* may be made of any known foam, as long as the foam of the core 22 is more breathable or allows air to pass therethrough more easily than the outer foam shell 24 of pillow 12.

As best shown in FIG. 3, an air passage 46 extends from the core 22 to the exterior surface 44 of the pillow 12 through the foam shell 24. The air passage 46 is preferably made of a fabric 47 which is air impermeable to allow air to flow through the air passage 46. As shown in FIG. 3, a distal or far end 48 of the air tube 18 is secured to an outer portion 50 of the air passage 46 of the pillow 12 in any conventional manner such as with adhesive or threads (not shown).

Figure 4:
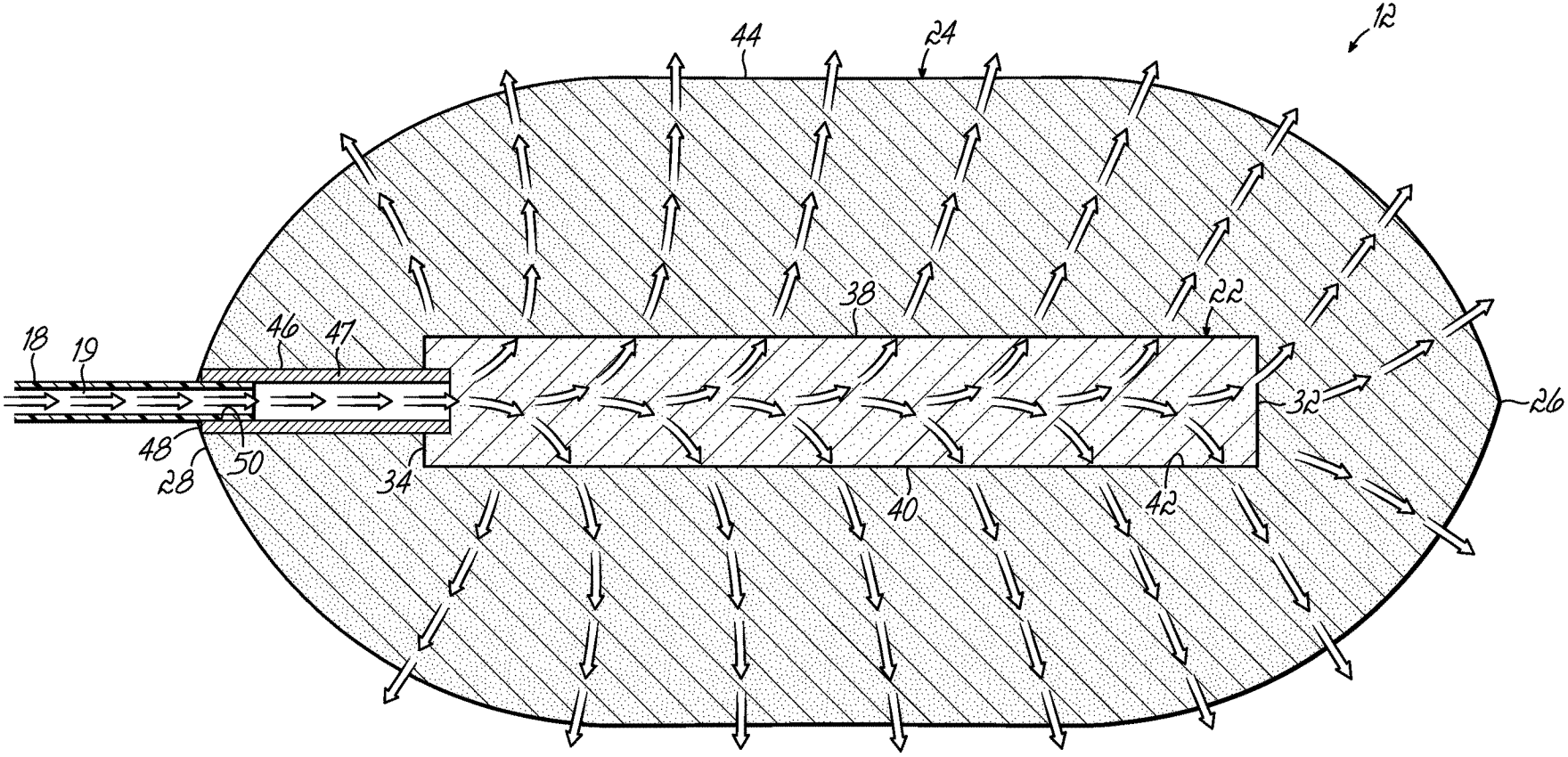
FIG. 4 is a cross-sectional view of the pillow of FIG. 3 showing the airflow through the pillow.

FIG. 4 shows air flow through the pillow 12 according to one embodiment of the present invention. The air flows through an interior 19 of the air tube 18 into the air passage 46, through the air passage 46 and into the core 22 of the pillow 12. From the core 22, air flows outwardly through the outer foam shell 24 of pillow 12, through an exterior surface 44 of the outer foam shell 24 of pillow 12 and into the environment.

Figure 7:
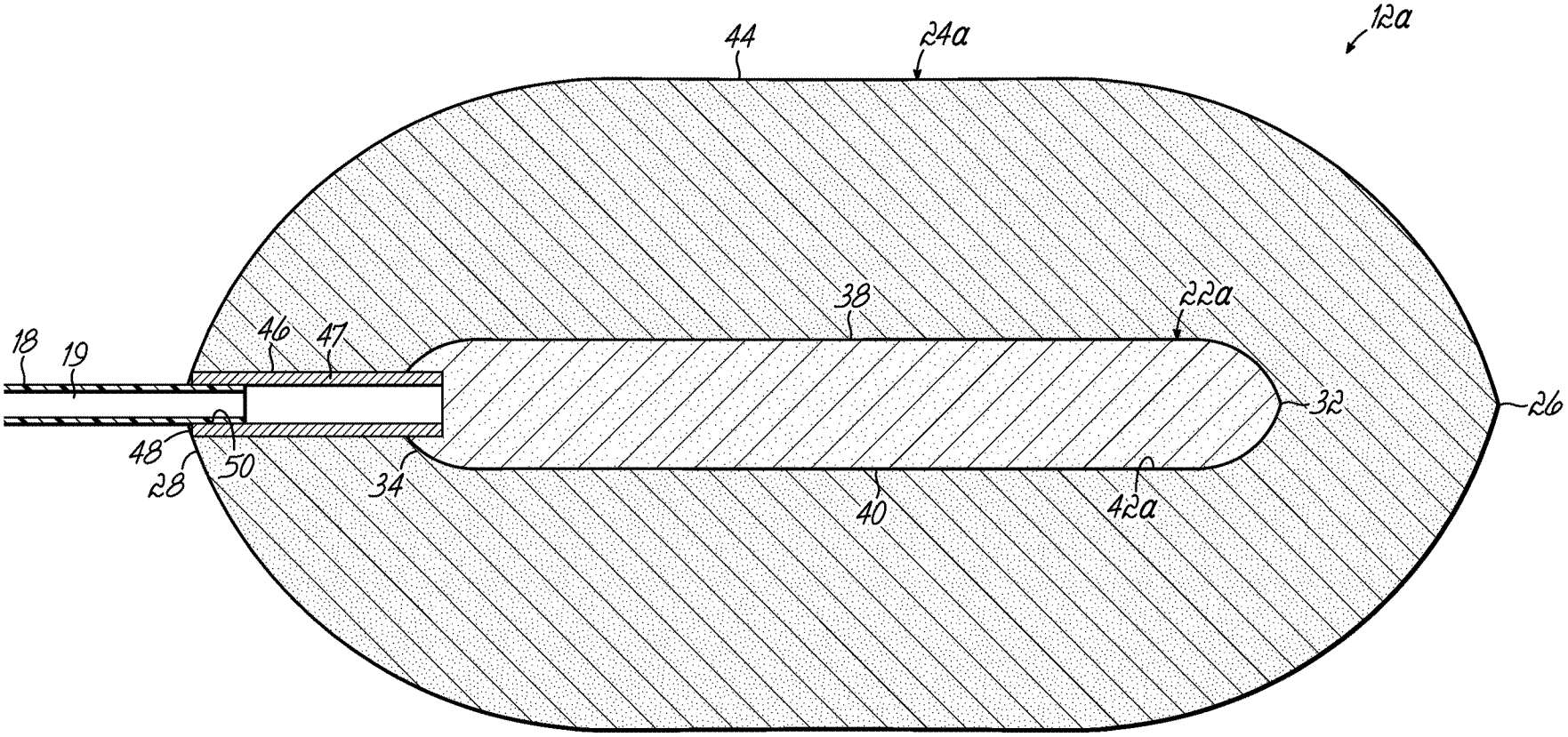
FIG. 7 is a cross-sectional view of another embodiment of pillow.

FIG. 7 illustrates an alternative embodiment of pillow 12*a* having the same shape and size as pillow 12 shown in FIG. 3. The pillow 12*a* has a solid foam core 22*a* having a different shape than the core 22 of pillow 12. The core 22*a* of pillow 12*a* may be made of any known foam, as long as the foam of the core 22*a* is more breathable or allows air to pass therethrough more easily than the outer foam shell 24*a* of pillow 12*a*. The outer foam shell 24*a* of pillow 12*a* has an internal cavity 42*a* shaped to fit the core 22*a* of pillow 12*a*. In the embodiment illustrated in FIG. 7, the core 22*a* has generally the same shape as the pillow 12*a*.

Figure 3A:
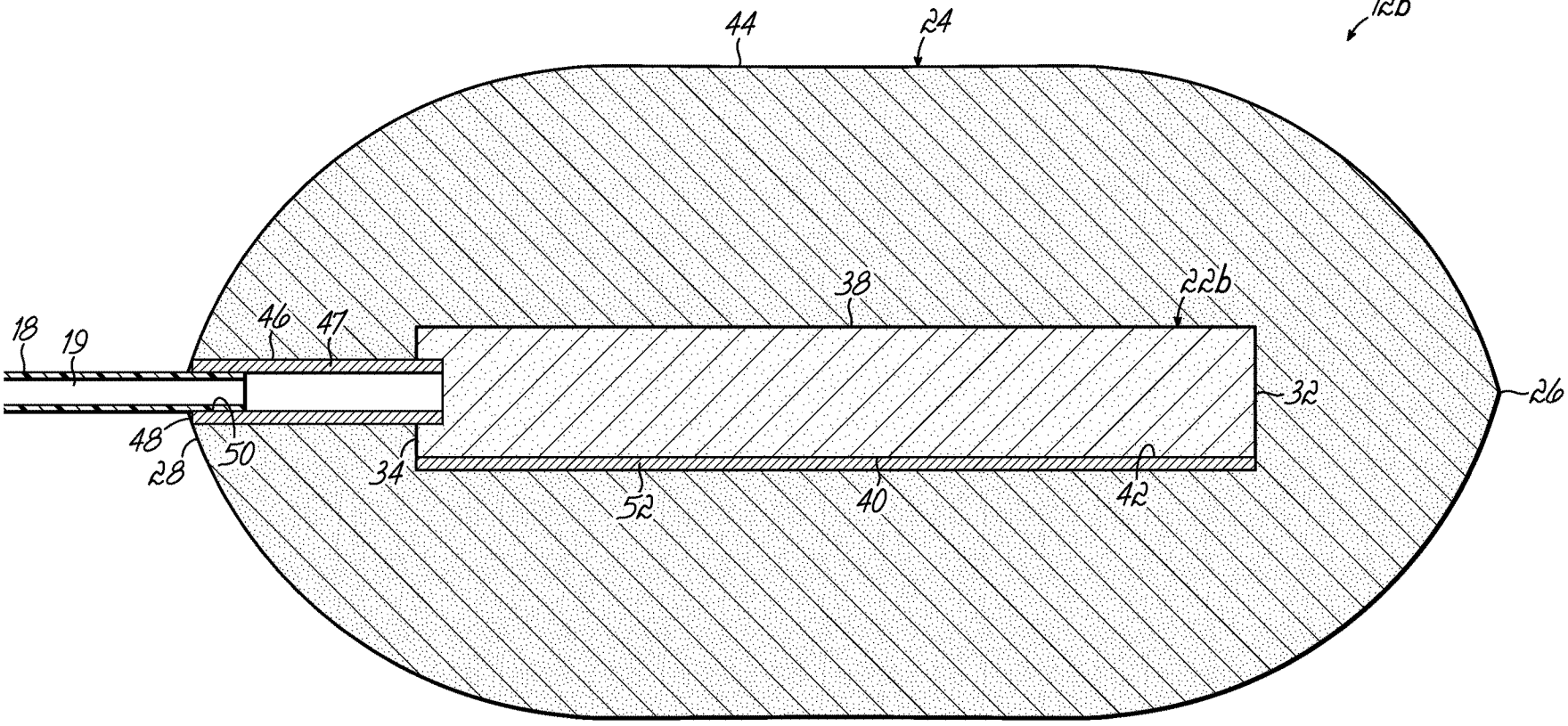
FIG. 3A is a cross-sectional view of an alternative embodiment of pillow having a core including an air-impermeable membrane.

FIG. 3A illustrates an alternative embodiment of pillow 12*b* which is identical to pillow 12 shown in FIG. 3, except the core is slightly different. The core 22*b* of pillow 12*b* has a fabric membrane 52 which is impervious to airflow. The fabric member 52 covers the bottom surface 40 of the core 22*b*.

Figure 4A:
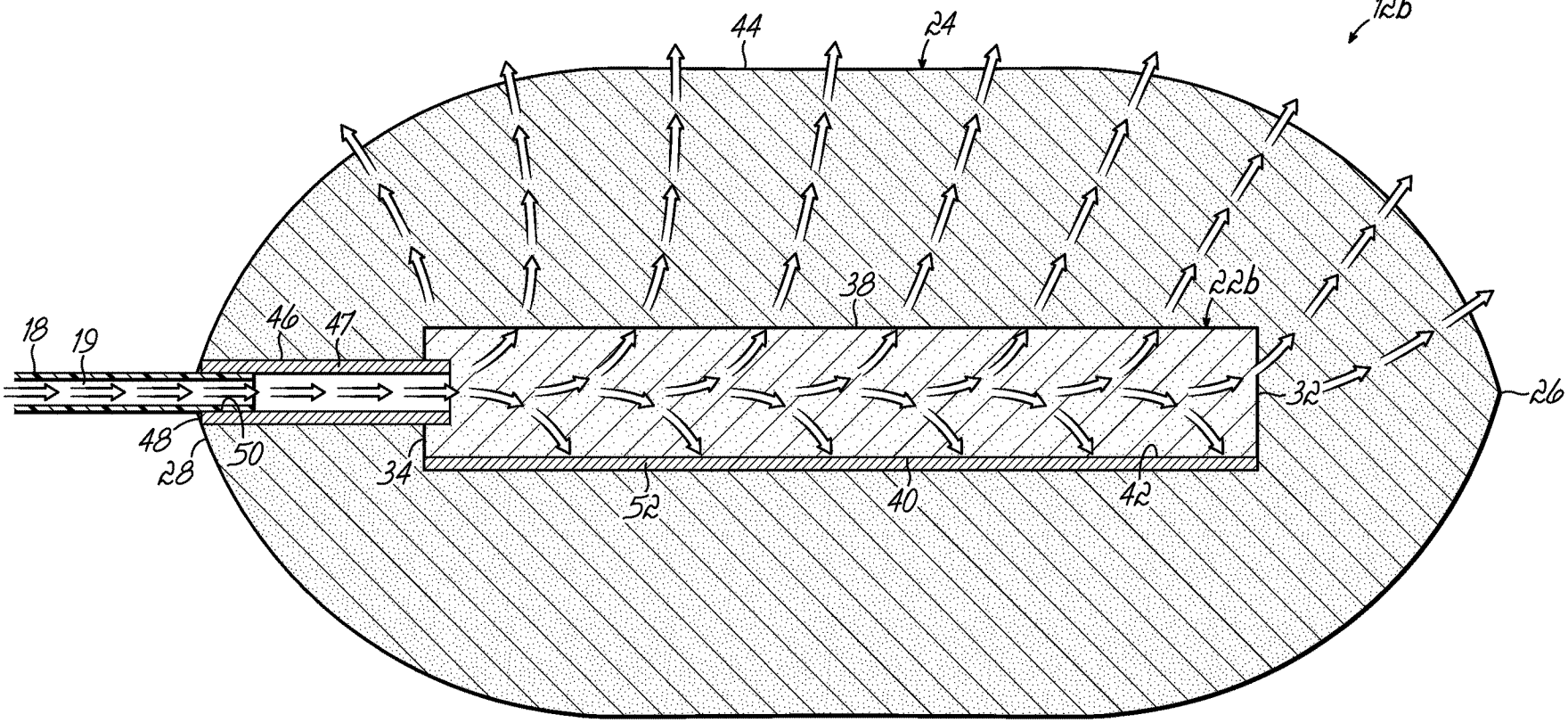
FIG. 4A is a cross-sectional view of the pillow of FIG. 3A showing the airflow through the pillow.

FIG. 4A shows air flow through the pillow 12*b* according to one embodiment of the present invention. The air flows through an interior 19 of the air tube 18 into the air passage 46, through the air passage 46 and into the core 22*b* of the pillow 12*b*. From the core 22*b*, air flows outwardly through the outer foam shell 24 of pillow 12*b*, through an exterior surface 44 of the outer foam shell 24 of pillow 12 and into the environment. The fabric membrane 52 prevents air from flowing downwardly because the fabric membrane 52 is impervious to airflow.

Figure 5:
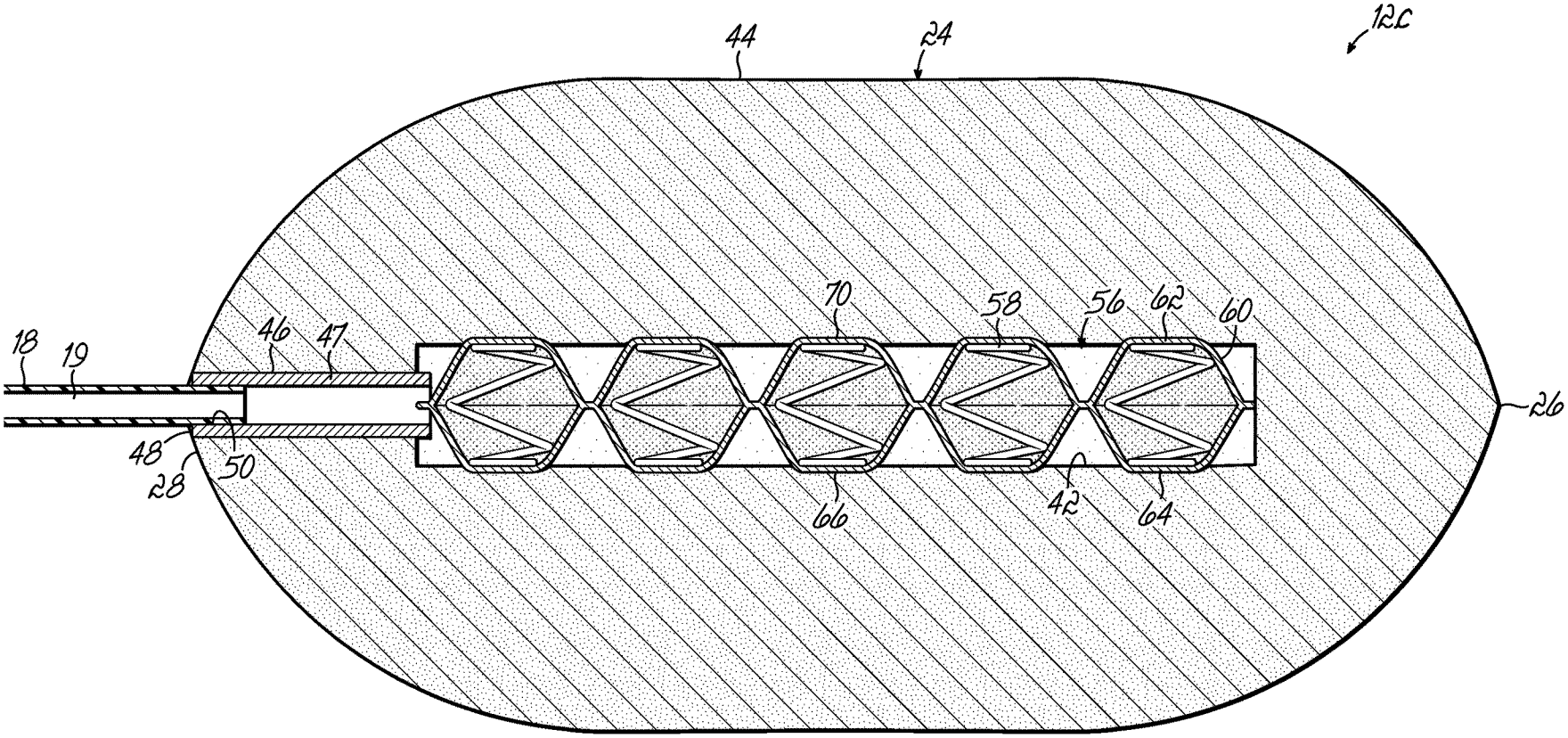
FIG. 5 is a cross-sectional view of an alternative embodiment of pillow having a core comprising pocketed coil springs without an air-impermeable membrane.

FIG. 5 illustrates an alternative embodiment of pillow 12*c* having the same shape and size as pillow 12 shown in FIG. 3. The pillow 12*c* has a different core 56 comprising individually pocketed coil springs instead of a foam core. As shown in FIG. 5, the core 56 comprises a layer of individually pocked coil springs 58, each coil spring 58 being located inside a fabric pocket 60 formed by joining upper and lower pieces of breathable fabric 62, 64, respectively. Again, the core 56 is more breathable or allows air to pass therethrough more easily than the outer foam shell 24 of pillow 12*c*. The outer foam shell 24 of pillow 12*c* has an internal cavity 42 shaped to fit the core 56 of pillow 12*c*. Although not shown, individually pocketed springs constructed in any known manner may be used as the core.

Figure 5A:
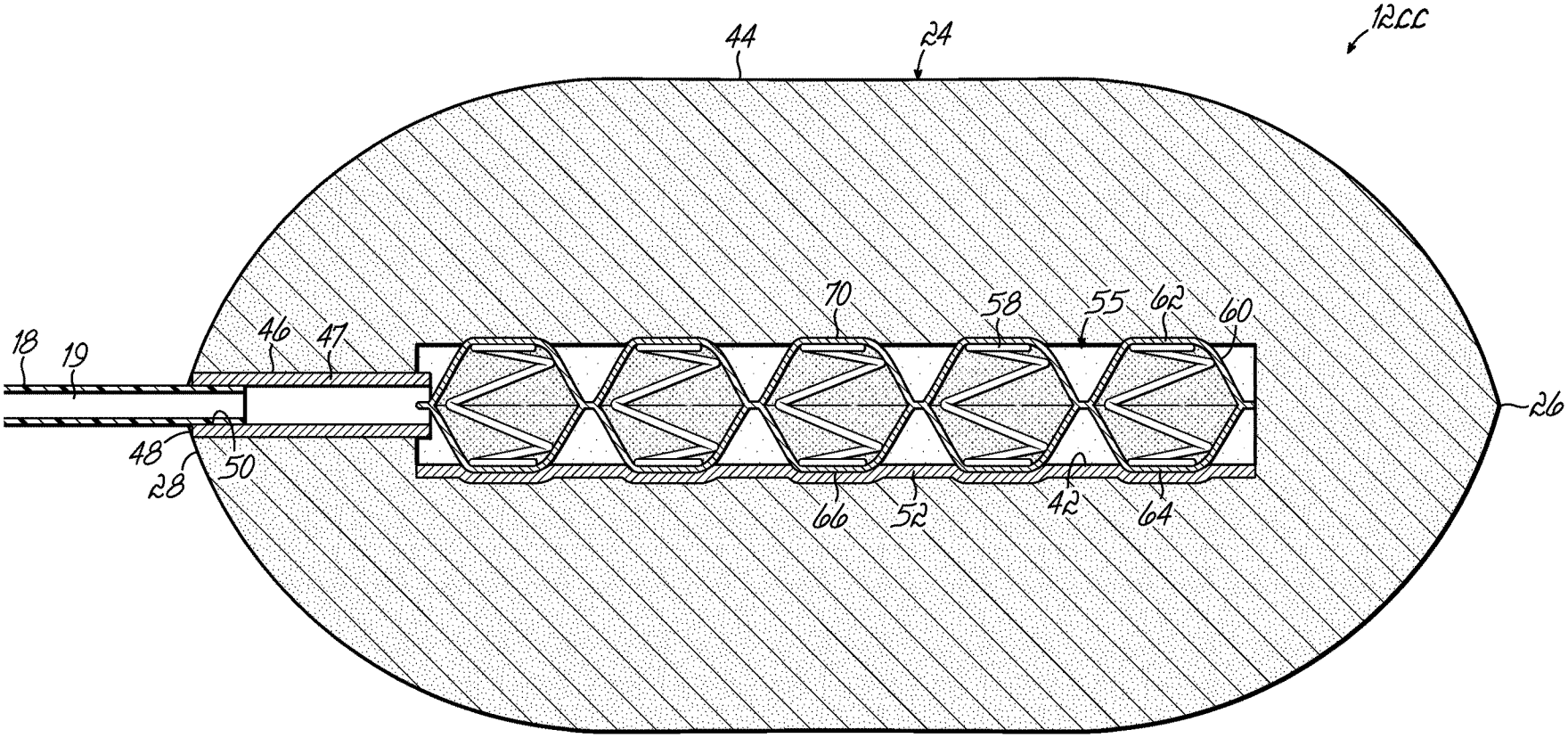
FIG. 5A is a cross-sectional view of another embodiment of a pillow showing a core comprising pocketed coil springs with an air-impermeable membrane.

FIG. 5A illustrates an alternative embodiment of pillow 12*cc* which is identical to pillow 12*c* shown in FIG. 5, except the core is slightly different. The core 55 of pillow 12*cc* has a fabric membrane 52 which is impervious to airflow. The fabric member 52 covers and is secured to the bottom surface 66 of the same core 56 shown in FIG. 5.

Figure 5B:
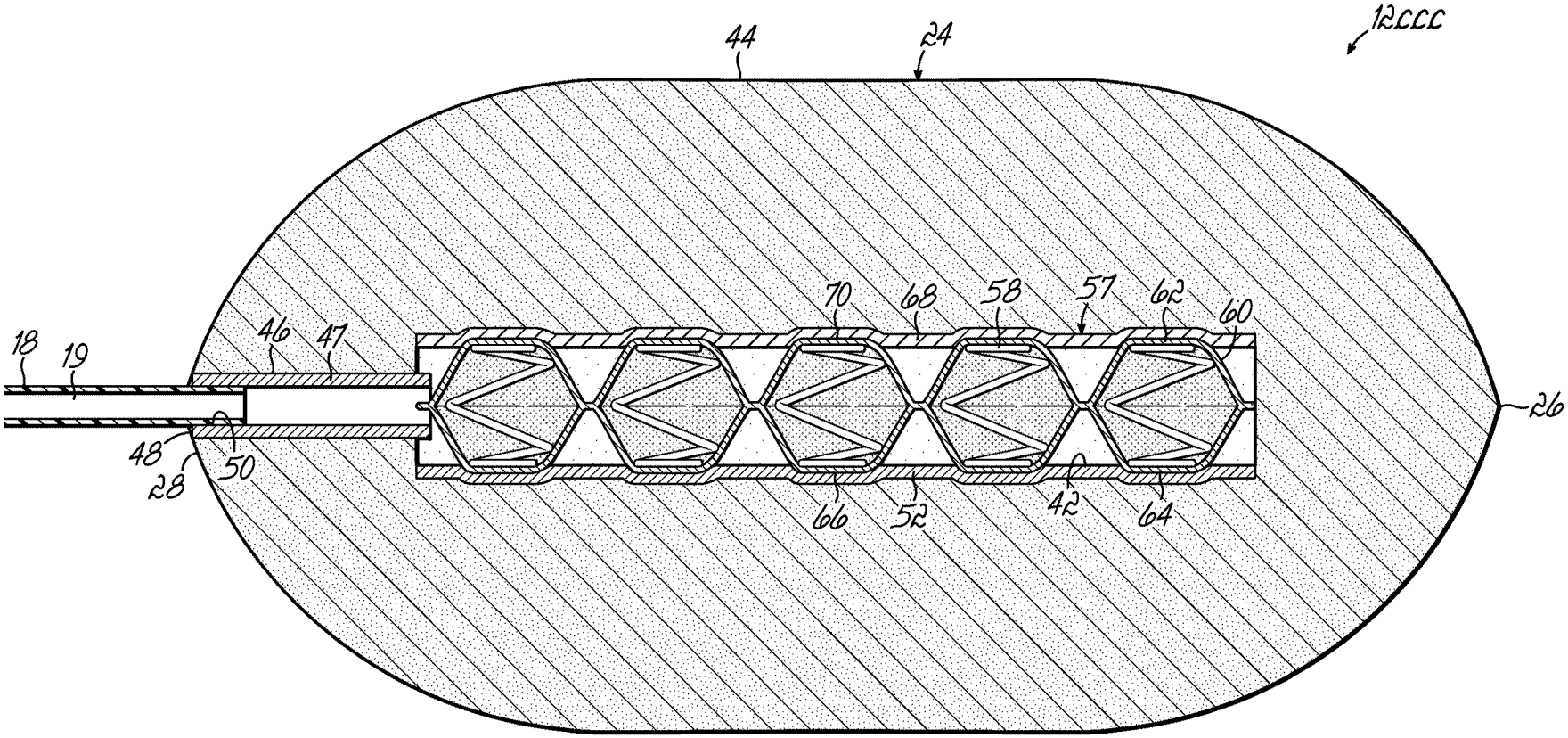
FIG. 5B is a cross-sectional view of another embodiment of a pillow showing a core comprising pocketed coil springs with one lower air-impermeable membrane and an upper breathable fabric membrane.

FIG. 5B illustrates an alternative embodiment of pillow 12*ccc* which is identical to pillow 12*cc* shown in FIG. 5A, except the core is slightly different. The core 57 of pillow 12*ccc* has a breathable fabric membrane 68 which allows air to flow therethrough in addition to the fabric membrane 52 described above. The fabric membrane 68 covers and is secured to the top surface 70 of the same core 55 shown in FIG. 5A.

Figure 6:
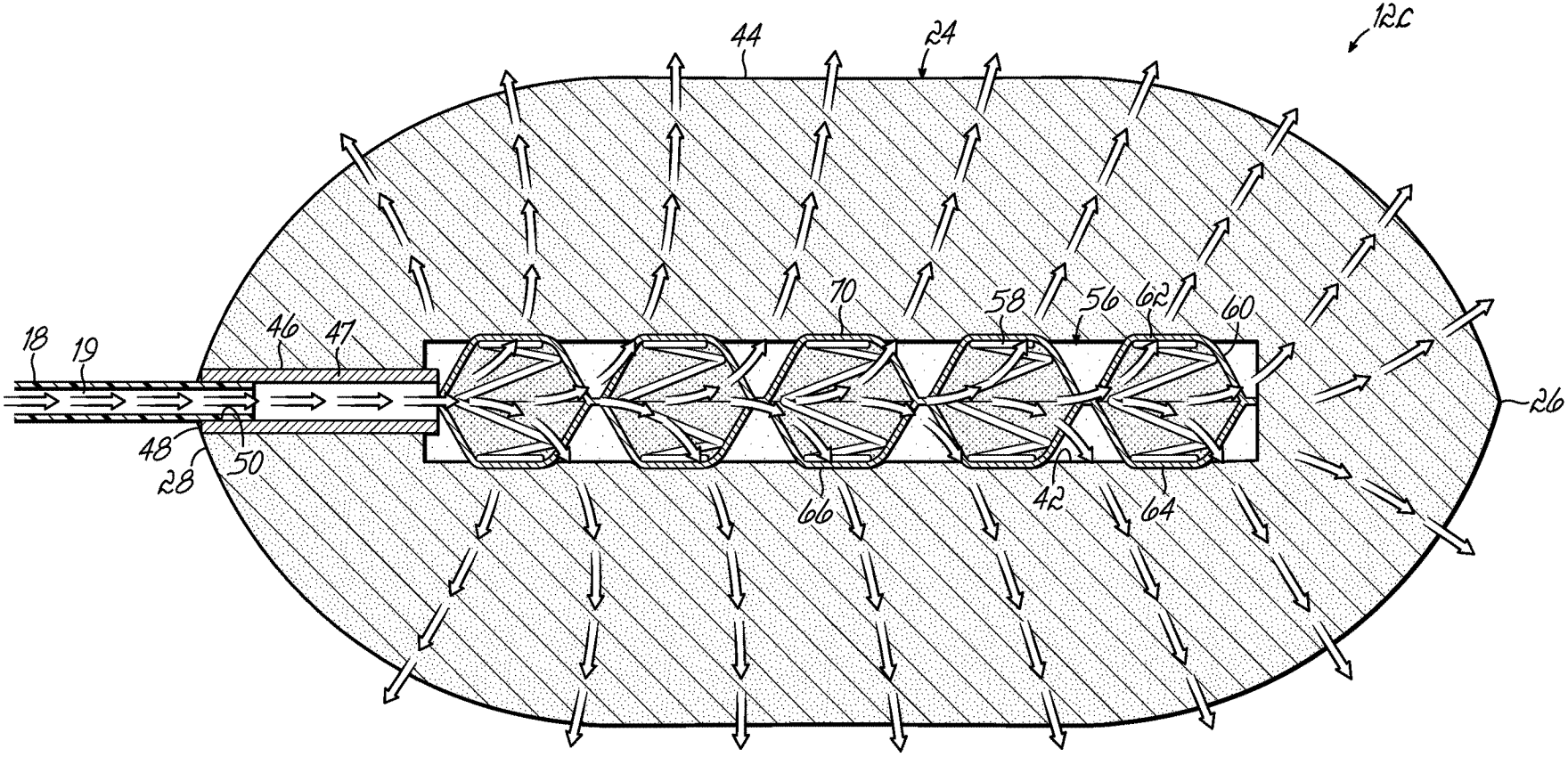
FIG. 6 is a cross-sectional view of the pillow of FIG. 5 showing the airflow through the pillow.

FIG. 6 shows air flow through the pillow 12*c* shown in FIG. 5 according to one embodiment of the present invention. The air flows through an interior 19 of the air tube 18 into the air passage 46, through the air passage 46 and into the core 56 of the pillow 12*c*. From the core 56, air flows outwardly through the outer foam shell 24 of pillow 12*c*, through an exterior surface 44 of the outer foam shell 24 of pillow 12*c* and into the environment.

Figure 6A:
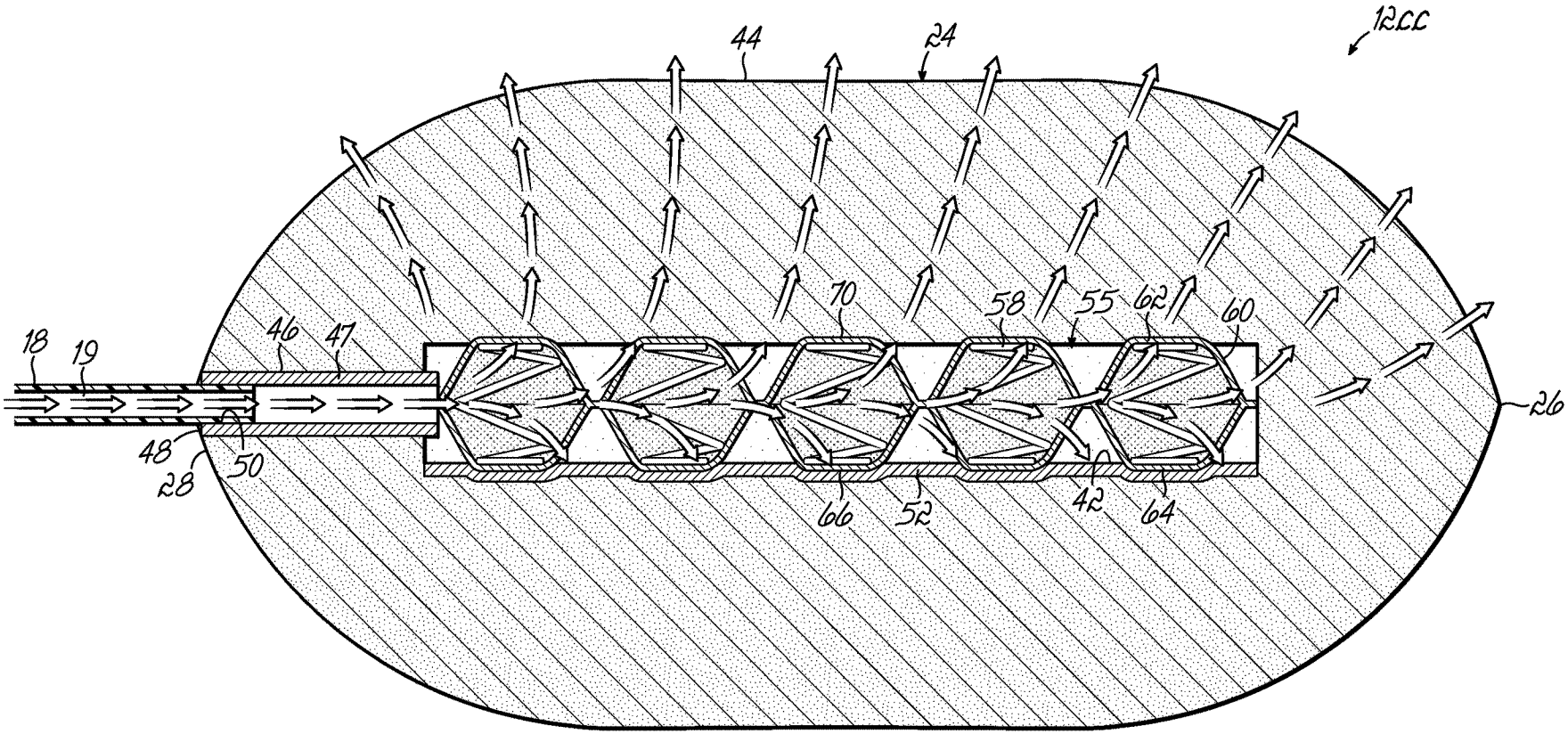
FIG. 6A is a cross-sectional view of the pillow of FIG. 5A showing the airflow through the pillow.

FIG. 6A shows air flow through the pillow 12*cc* shown in FIG. 5A according to one embodiment of the present invention. The air flows through an interior 19 of the air tube 18 into the air passage 46, through the air passage 46 and into the core 55 of the pillow 12*cc*. From the core 55, air flows outwardly through the outer foam shell 24 of pillow 12*cc*, through an exterior surface 44 of the outer foam shell 24 of pillow 12*cc* and into the environment.

Figure 6B:
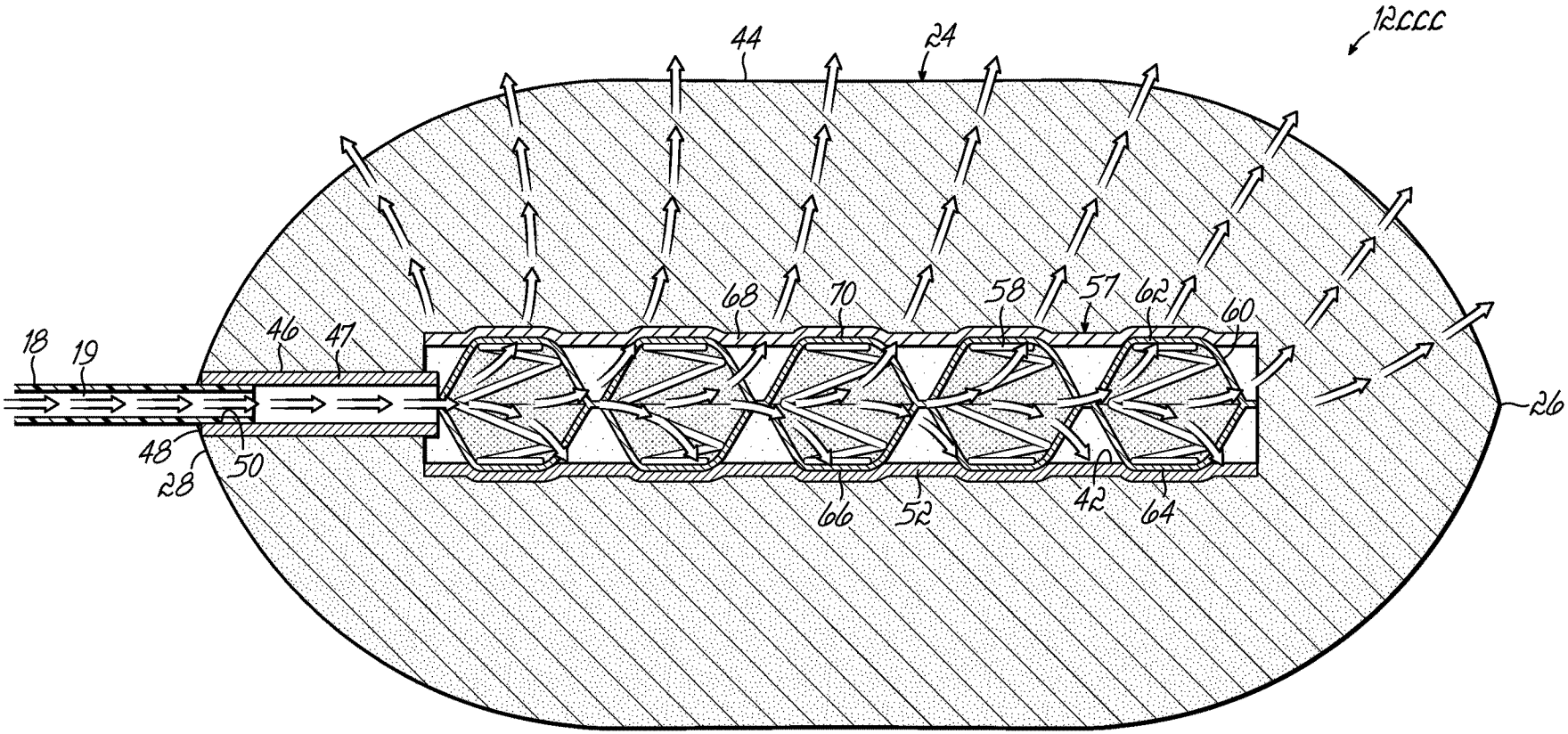
FIG. 6B is a cross-sectional view of the pillow of FIG. 5B showing the airflow through the pillow.

FIG. 6B shows air flow through the pillow 12*ccc* shown in FIG. 5B according to one embodiment of the present invention. The air flows through an interior 19 of the air tube 18 into the air passage 46, through the air passage 46 and into the core 57 of the pillow 12*ccc*. From the core 57, air flows outwardly through the outer foam shell 24 of pillow 12*ccc*, through an exterior surface 44 of the outer foam shell 24 of pillow 12*ccc* and into the environment.

FIG. 8A illustrates the blower unit 14 as shown in FIG. 1. The blower unit 14 has an insulated housing 16 for noise dampening, a blower fan 70 and an outlet 72 to which the air tube 18 is coupled in any conventional manner. The blower unit 14 has an ambient air intake 74 having an air filter 76. The blower unit 14 further comprises a control panel 78 including a power button 80 and a speed control 82. Wiring 84 having a plug 86 powers the blower unit 14. FIG. 8B illustrates an alternative blower unit 14*a* which may be powered by blue tooth or wi-fi as shown by box 90.

FIG. 8C illustrates another blower unit 14*c* having two blower fans 70. The blower unit 14*c* has an insulated housing 16 for noise dampening, two blower fans 70, two outlets 72, each one of which may be coupled to an air tube 18 is in any conventional manner. The blower unit 14*c* has an ambient air intake 74 having an air filter 76. The blower unit 14*c* further comprises a control panel 92 including a power button 94 and a sync button 96. Wiring 84 having a plug 86 powers the control panel 92. The blower fans 70 which may be powered by blue tooth or wi-fi as shown by box 90.

Figure 8D:
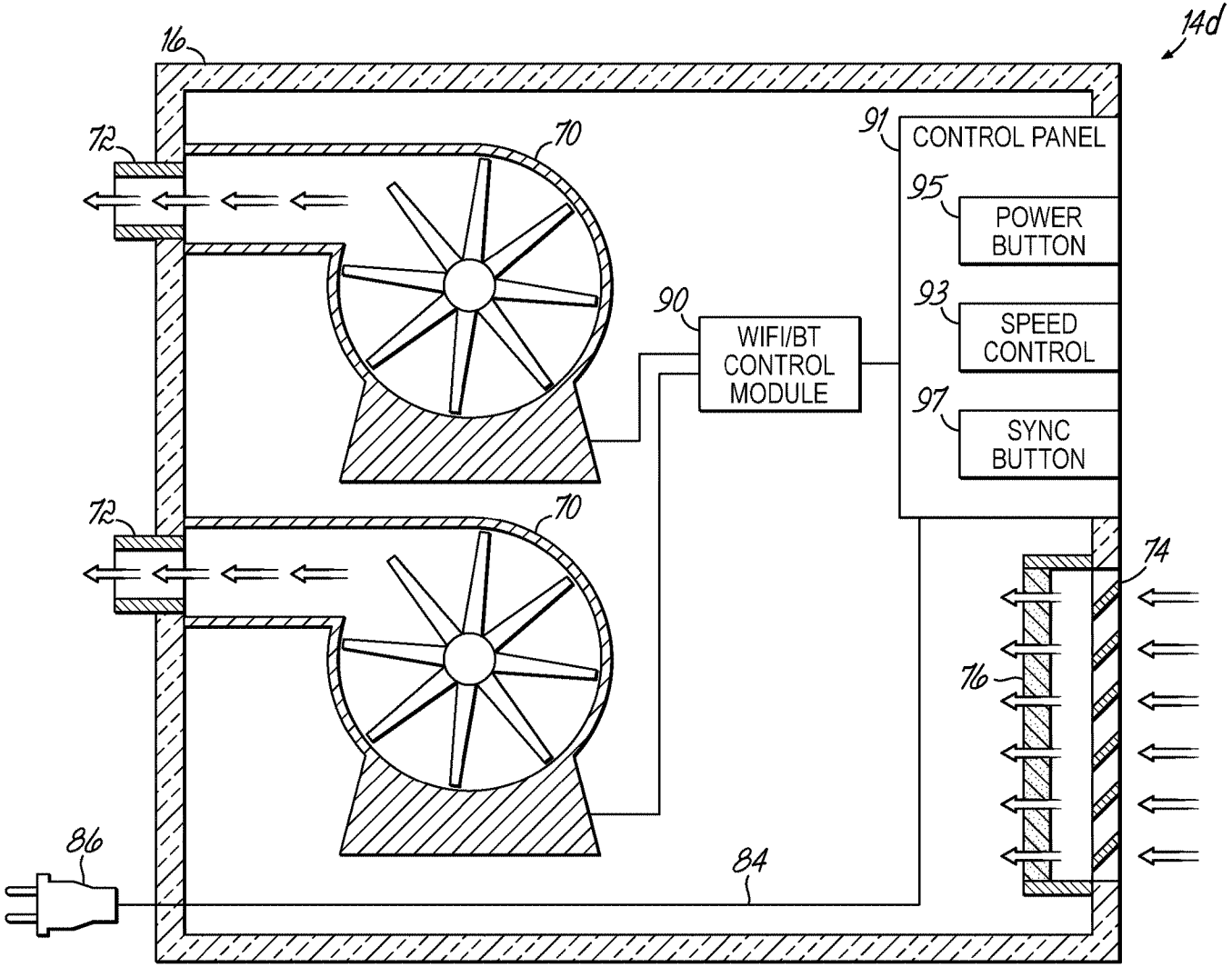
FIG. 8D is a schematic cross-sectional view of another embodiment of blower unit.

FIG. 8D illustrates another blower unit 14*d* having two blower fans 70. In this blower unit 14*d*, the control panel 91 has a speed control 93 in addition to a power button 95 and a sync button 97.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A pillow cooling system comprising:

a pillow sized to be positioned on top of a mattress at a location of the mattress to support a head of a user, the pillow comprising a core and a foam shell surrounding and in fluid communication with all sides of the core, the foam shell has an internal cavity that is filled by the core;

an air passage extending from the core to an exterior surface of the pillow;

a blower unit comprising an air tube configured to be connected in fluid communication with the air passage of the pillow, the blower unit comprising a fan;

wherein upon activation and connection, the fan of the blower unit is configured to push ambient air through the air tube into the air passage into the core of the pillow, through the core of the pillow into the foam shell of the pillow and exits the pillow after passing through the foam shell.

2. The pillow cooling system of claim 1, wherein the core of the pillow defines a core top, a core bottom, a core front edge and a core back edge, wherein the core comprises a different foam than the foam shell that extends from the core top to the core bottom and from the core front edge to the core back edge.

3. The pillow cooling system of claim 1, wherein the blower unit is insulated for noise reduction and the fan is a blower type fan.

4. The pillow cooling system of claim 1, wherein the core of the pillow defines a core top, a core bottom, a core front edge and a core back edge, wherein upon activation and connection, the fan of the blower unit is configured to push ambient air through the air tube into the air passage into the core of the pillow, out of at least the core top and the core bottom and into the foam shell of the pillow and exits the pillow after passing through the foam shell.

5. The pillow cooling system of claim 1, wherein the core of the pillow defines a core top, a core bottom, a core front edge and a core back edge, wherein the core comprises pocketed mini coil springs, each extending from the core bottom to the core top.

6. The pillow cooling system of claim 1, wherein the foam shell of the pillow is made of polyurethane.

7. The pillow cooling system of claim 1, wherein the fan is controlled remotely.

8. A pillow cooling system comprising:

a pillow sized to be positioned on top of a mattress at a location of the mattress to support a head of a user, the pillow comprising a core and a foam shell surrounding the core, the core and foam shell of the pillow both have a cross-sectional shape when viewed from a side that has parallel top and bottom portions in a middle section and tapered edge sections;

an air passage extending from the core to an exterior surface of the pillow;

a blower unit comprising an air tube configured to be connected in fluid communication with the air passage of the pillow, the blower unit comprising a fan;

wherein upon activation and connection, the fan of the blower unit is configured to pull ambient air through the foam shell of the pillow into all sides of the core of the pillow and then through the air passage of the pillow into the air tube of the blower unit.

9. The pillow cooling system of claim 8, wherein the core of the pillow allows air to pass therethrough more easily than the foam shell of the pillow.

10. The pillow cooling system of claim 8, wherein the blower unit is insulated for noise reduction.

11. The pillow cooling system of claim 8, wherein the core of the pillow is made of reticulated foam.

12. The pillow cooling system of claim 8, wherein the core of the pillow is made of pocketed mini coil springs.

13. The pillow cooling system of claim 8, wherein the foam shell of the pillow is made of polyurethane.

14. The pillow cooling system of claim 8, wherein the blower unit's speed is controlled remotely.

15. A method of cooling a pillow comprising:

providing a pillow sized to be positioned on top of a mattress at a location of the mattress to support a head of a user, the pillow comprising a core and a foam shell surrounding all sides of the core, the foam shell has an internal cavity that is filled by the core; and activating a fan of a blower unit to push air through an air tube extending outwardly from the blower unit, through an air passage extending from the core of the pillow to an exterior surface of the pillow, wherein upon activation, the fan of the blower unit pushes ambient air through the air tube and air passage into the core of the pillow, a breathability of the core of the pillow allowing the air to pass through all sides of the core of the pillow into the foam shell of the pillow, through the foam shell of the pillow and exit the pillow.

16. The method of claim 15, wherein the fan of the blower unit is activated remotely.

17. The method of claim 15, wherein air flows more easily through the core of the pillow than the foam shell of the pillow.

18. The method of claim 15, wherein the core and foam shell of the pillow are made of different foams.

19. The method of claim 15, wherein the core and foam shell of the pillow both have a cross-sectional shape when viewed from a side that has parallel top and bottom portions in a middle section and tapered edge sections.

20. The method of claim 15, wherein the core of the pillow is one of the following: pocketed coil springs, melt blown fiber mesh, spacer fabric and reticulated foam.

* * * * *